United States Patent [19]

Kredo

[11] Patent Number: 4,681,155

[45] Date of Patent: Jul. 21, 1987

[54] LIGHTWEIGHT, COMPACT HEAT EXCHANGER

[75] Inventor: Theodore A. Kredo, Torrance, Calif.

[73] Assignee: The Garrett Corporation, Los Angeles, Calif.

[21] Appl. No.: 858,481

[22] Filed: May 1, 1986

[51] Int. Cl.[4] ..... F28F 3/00

[52] U.S. Cl. ..... 165/76; 165/166; 138/163; 138/171

[58] Field of Search ..... 165/166, 76; 138/163, 138/171

[56] References Cited

U.S. PATENT DOCUMENTS

| | | | |
|---|---|---|---|
| 1,840,318 | 1/1932 | Horvath | 165/153 |
| 2,167,737 | 8/1939 | Anderson | 138/171 X |
| 2,275,572 | 3/1942 | Somers | 138/163 X |
| 2,339,284 | 1/1944 | Modine | 257/128 |
| 2,912,749 | 11/1959 | Bauernfiend et al. | 29/157.3 |
| 3,212,572 | 10/1965 | Otto | 165/166 |
| 3,495,656 | 2/1970 | Dickson | 165/166 |
| 4,125,153 | 11/1978 | Stoneberg | 165/166 |
| 4,350,201 | 9/1982 | Steineman | 165/76 |
| 4,393,862 | 7/1983 | Wilke | 165/76 X |
| 4,501,321 | 2/1985 | Real et al. | 165/153 |

FOREIGN PATENT DOCUMENTS

| | | | |
|---|---|---|---|
| 173399 | 12/1953 | Austria . | |
| 29315 | 6/1924 | France . | |
| 488571 | 7/1938 | United Kingdom . | |
| 636839 | 5/1950 | United Kingdom . | |
| 818603 | 8/1959 | United Kingdom | 165/166 |

*Primary Examiner*—Albert W. Davis, Jr.
*Assistant Examiner*—Richard R. Cole
*Attorney, Agent, or Firm*—J. Henry Muetterties; Albert J. Miller

[57] ABSTRACT

A heat exchanger of the type characterized by a plurality of preassembled heat exchanger tubes separated by cooling fins. Each tube is formed from two identical U-shaped members having a folded and unfolded end. The unfolded end of each is slid into the fold end of the other. The secondary of cool air flow path is defined by a pair of formed header bars alternated with the tubes. Side plates and manifolds are added to complete the heat exchanger.

8 Claims, 5 Drawing Figures

41
44
48
45
42
42
45
48
44
40

32
34
34
32

10
52
50
28
50
52
26
30
30
24
24
28
32
26
50

LIGHTWEIGHT, COMPACT HEAT EXCHANGER

BACKGROUND AND SUMMARY OF THE INVENTION

This invention relates to a heat exchanger construction. More specifically, this invention relates to a heat exchanger core including a design which increases the heat exchange surface area for a given volume.

Heat exchangers in general are well known in the prior art, and typically comprise a heat exchanger core having dual fluid flow paths for passage of two fluids in heat exchange relationship with each other without intermixing. In one common form, such heat exchangers typically comprise a plurality of relatively thin divider plates arranged in an alternating stack with a plurality of extended surface heat transfer elements, such as corrugated fins and the like. The extended surface heat transfer elements, or fins, are commonly turned alternately at right angles with respect to each other to define two closely adjacent fluid flow paths for passage of the two working fluids at right angles to each other. This construction is commonly known as a cross flow heat exchanger, and includes appropriate header bars along side margins of the stack to isolate the two working fluids from one another. When the stack is assembled, the various components thereof are commonly secured together preferably in a single bonding operation, such as brazing or the like.

Heat exchangers further require some type of manifold or header structure for guiding at least one of the working fluids for ingress and egress with respect to its associated flow path through the heat exchanger core in isolation from the other working fluid. For example, when the heat exchanger is used to transfer heat energy between a liquid and a gas, the liquid is normally supplied through an appropriate inlet conduit to an inlet manifold connected to the heat exchanger core. The inlet header guides the liquid for flow into and through one of the flow paths in the core in heat transfer relationship with the gas which typically flows freely without headers through the other core fluid flow path. An outlet header connected to the heat exchanger core collects the liquid discharged from one of the fluid flow paths for passage away from the heat exchanger through an appropriate outlet conduit.

Manufacturers of vehicles employing internal combustion engines generally dictate the size and location of under-the-hood accessories supplied by manufacturers of these accessories. Therefore, once the particular space limitations are placed upon the supplier, it is of utmost importance to design a component which fits within that space limitation and meets the vehicle manufacturer's performance requirements. In the case of heat exchangers, once given the space limitations on the heat exchanger, it is important to maximize the heat and weight transfer characteristics in order to minimize the size of the overall heat exchanger. In order to accomplish this, it is necessary to maximize the cooling of the hot liquid coolant exiting the engine.

A common problem with the heat exchangers of the prior art rests in their design of the liquid core flow path. More specifically, these heat exchangers utilize a solid header bar on either side of the corrugated fins to define the core fluid flow path. As such, these solid bars do not provide a maximization of the heat transfer between the hot liquid flowing through the flow path defined by these solid bars and the cooler gas flowing in cross-flow relationship thereto. The solid bars also contribute to substantial weight penalties.

The present invention overcomes the problems and disadvantage of the prior art heat exchangers by providing an improved heat exchanger construction including tubes which eliminate the need for solid bars and more importantly maximize the fin density within the core passage.

In accordance with the present invention, a heat exchanger comprises a heat exchanger core defining a pair of fluid flow paths for passage of a pair of working fluids in heat transfer relationship with each other and integrally mounted inlet and outlet headers for guiding one of the working fluids into and through one of the flow paths in isolation with the other fluid.

Each fluid flow path is actually made of a plurality of smaller flow paths. The first or hot fluid flow path is defined by a plurality of tubes which are spaced apart from the adjacent tube by two formed header bars. The second or cool fluid flow path is defined by a plurality of cross-flow spaces between the plurality of tubes and the formed header bars. Generally, the end passages of the core are cross-flow spaces and require solid end plates to define the outermost boundaries of the cross-flow space.

Each tube comprises two identically formed members which are complementary to each other. More specifically, the tubes are generally U-shaped having an elongated base section and upright legs on each side of the base section. One leg of each of the members is folded back over itself twice. The first and second folds are spaced apart from one another thereby forming a trough which runs the length of the member. The two identically formed complementary members are then placed one on top of each other with the non-folded end of each member being inserted to the trough of its complementary member. Assembled in this manner, the two pieces form a fluid fluid core flow path therebetween. Inserted between the two members either before or after assembly thereof is a corrugated heat transfer element fin. Tubes formed in this manner are alternated with formed header bars running at right angles thereto.

The formed header bars define the boundary width of each of the smaller second flow paths. The formed header bars are generally C-shaped in cross section and include a lanced tab extended from its central portion at each horizontal end thereof. The tabs at each end of the bars are folded inward and over itself. Inserted between the two formed header bars during assembly of the heat exchanger core is a corrugated heat transfer fin element. The spaced bars thereby define the width of the second flow path while the two tubes spaced by the bars define the height of the second small passages. Once the desired number of tubes and pairs of formed header bars have been stacked, side plates are placed over the exposed extended surface heat transfer elements of the cross-flow path. Headers are then attached to the core ends to which the first fluid flow paths are open.

It is an object of this invention to provide a heat exchanger core design which maximizes the heat exchanger fin density for a given volume.

It is another object of this invention to provide a lightweight, compact heat exchanger.

It is another object of this invention to provide an heat exchanger core which is easy to assembly.

DETAILED DESCRIPTION OF THE PREFERRED EMBODIMENT

Figure 1:
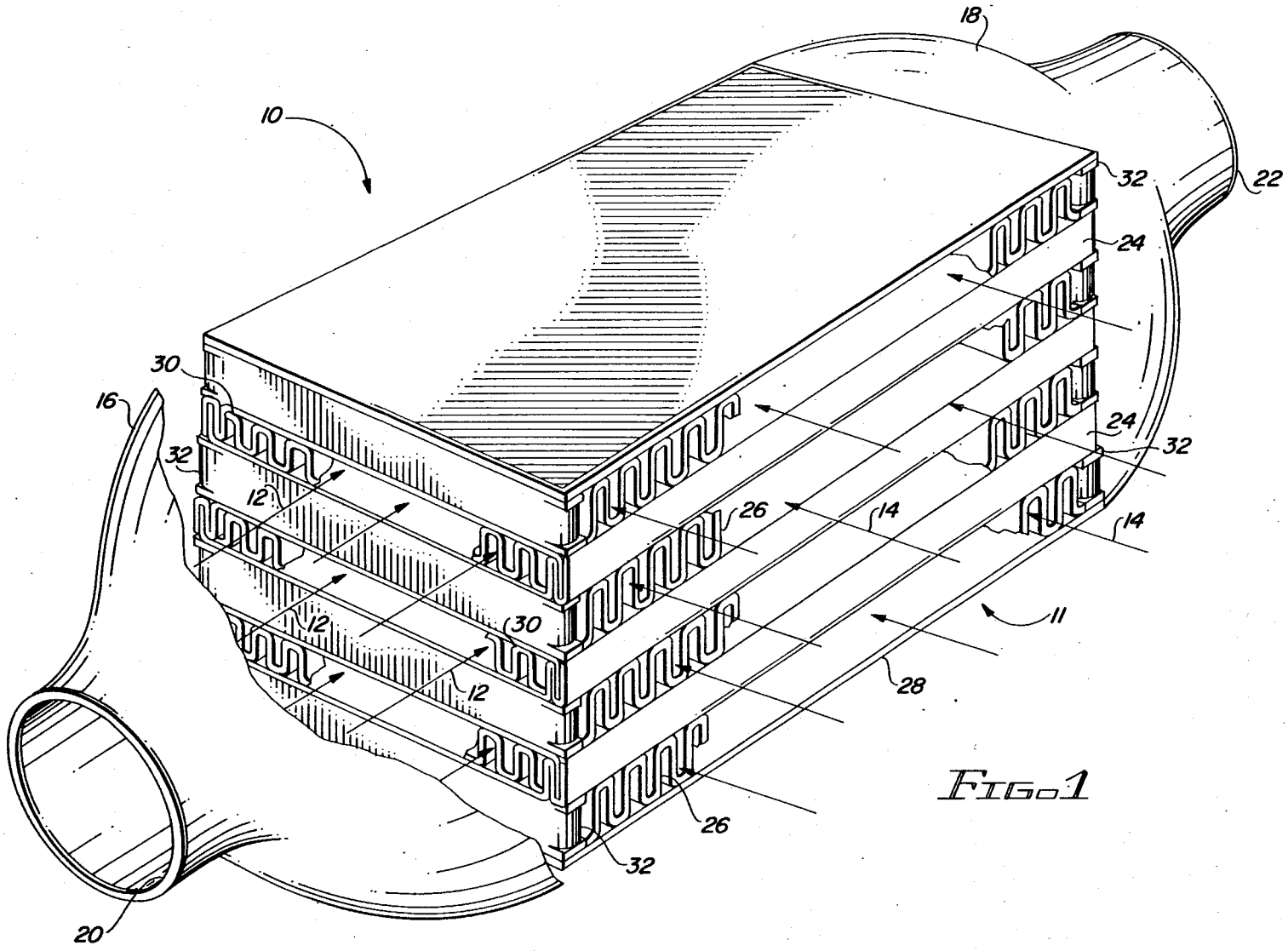
FIG. 1 is a perspective view of the heat exchanger of the present invention.

As shown in the exemplary drawings, the heat exchanger embodying the novel features of this invention is referred to generally by the reference numeral 10. Heat exchanger 10 includes a core 11 defining a pair of internal flow paths designated by the numerals 12 and 14, for passage of two working fluids in heat exchanger relationship to each other. One of the working fluids is coupled for flow to and from the heat exchanger 10 through an inlet manifold 16 and an outlet manifold 18. These manifolds 16 and 18, are mounted integrally with the heat exchanger core 11 and respectively include fluid fittings, 20 and 22, for connections to the appropriate conduits.

The heat exchanger 10 of this invention provides a simplified and economical, yet highly versatile, heat exchanger construction. The heat exchanger advantageously can be assembled from its various components, and then those components can be appropriately connected to each other in a single bonding operation such as brazing or the like.

As shown in the figures, the heat exchanger core 11 is formed by a plurality of tubes 24 stacked alternately with a plurality of pairs of formed header bars 32 which space tubes 24 from adjacent tubes. The tubes 24 include therein corrugated fins 30 which run the length of the tube. The header bars 32 define the width of the second fluid flow path through these fin elements. As shown in the drawing, the second smaller passages includes an extended surface heat transfer elements or fins 26. The outer two passages of core 11 are passages which make up the second flow path 14 and are enclosed by using a side plate 28 on both sides of the core. Attached to the ends of the core where the tube passages are exposed are the inlet and outlet manifold 16 and 18 respectively.

Tubes 24 are formed from the mating of two identical members 40 and 41. Each member is generally U-shaped having an elongated base 42 and ends, 44 and 45, bent into a generally perpendicular relationship with the base 42. Second end 45 of each member is folded over itself twice such that the first and second fold define a trough 48 the length of the member 40. Tubes 24 are therefore formed by placing member 41 upside down in relationship to member 40 and sliding the unfolded end 44 of one member into the trough 48 within the folded end 45 of member 40, and the unfolded end 44 of member 40 into the trough 48 of the folded end 45 of top member 41. Located within the tubes 24 are corrugated fin elements 30 (FIG. 1). Tubes 24 are arranged in layers throughout the heat exchanger core 11 and define a first flow path 12 for passage of said working fluid. Tubes of this type can have a wall thickness as thin as 0.010 inches.

The extended heat transfer fin elements 26 also have a generally corrugated fin like construction to define a plurality of relatively small flow passages extending in a cross-flow direction with respect to tubes 24 and therefore the first flow passage 12. The plurality of these cross-flow passages define a second fluid flow path 14 for passage of a second working fluid in layers throughout the heat exchanger core 11. As can be seen from the drawings, the base section of the tubes 42 prevent the mixing of the two working fluids. The second fluid flow path 14 bounded by a pair of formed bars 32 which run the length of the second fluid flow path. The bars 32 are formed with lanced end tabs 34 at both longitudinal ends thereof. The lanced tabs 34 are folded over at each end to provide increased compression corner strength, a land to weld flanges or manifolds to, if required, and a reduction of the gap between formed bar 32 and adjacent element 26. Bars 32 are generally C-shaped in cross-section and therefore provide a generally stable base on which to stack the tubes 24.

The heat exchanger is adapted for use within a stream of gas, such as air, which constitutes the second working fluid. More specifically, the opposite ends of the second flow path 14 are exposed for open flow of gas without any manifold or header structure. This gas thus passes in heat exchange relationship with the first working fluid coupled for flow through the first flow path 12.

The first flow path 12 is isolated from the second flow path 14 to prevent physical intermingling of the two working fluids. In this regard, the inlet and outlet headers 16 and 18 are mounted generally at opposite ends of the first flow path 12 defined by tubes 24 for communicating the first working fluid such as a liquid coolant or the like for flow through the first flow path. Importantly, the peripheral boundaries of the second flow path 14 are closed by appropriately shaped bars 32 to isolate the second flow path from the first working fluid within the headers.

Figures 2, 3A, 3B, 4:
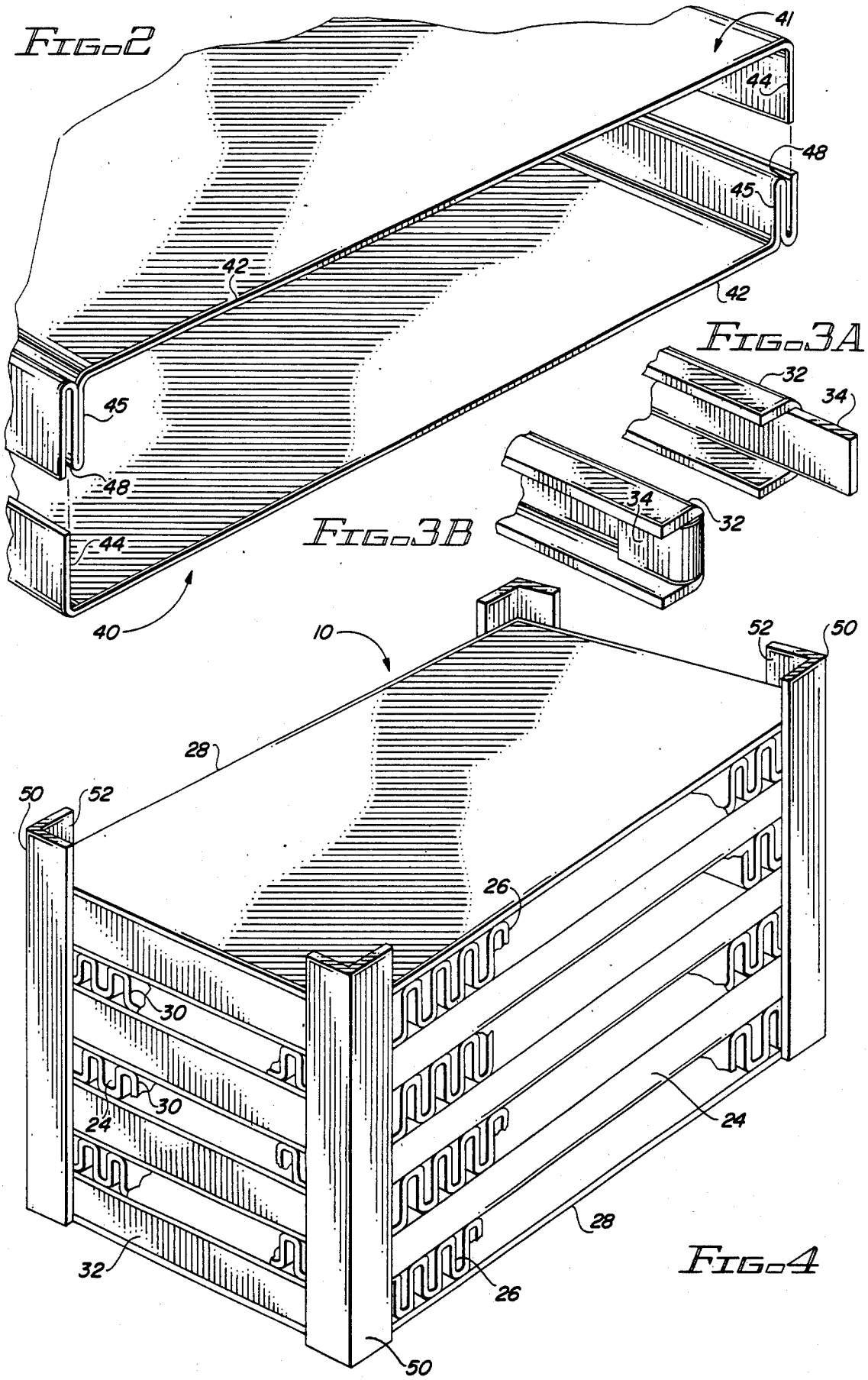
FIG. 2 is a partial perspective view of the formed two piece two passage.
FIG. 3*a* and FIG. 3*b* are a partial perspective view of the end bars showing the lanced tabs before and after final forming.
FIG. 4 is a perspective view of the apparatus used to assemble the heat exchanger core.

In accordance with the present invention, the heat exchanger core 10 is constructed by stacking four corner bars or members 50 at a predetermined distance from each other as shown in FIG. 4. Each corner bar 50 includes a squared cutaway section 52. A first heat exchanger side plate 28 is placed on a flat surface of a bonding fixture and thereafter alternately stacking smaller second and first fluid flow details defining the first and second flow passages atop thereof.

In this manner, a spacer unit of the corrugated fin element 26, located between the two end bars 32, is placed atop the side plate 28. Tubes 24, having been preassembled are then placed in cross-flow relationship to the second flow path 14. Continuing in this manner a heat exchanger 10 of the appropriate dimensions can be formed. A second heat exchanger side plate 28 is necessary in order to define and close the outermost second flow path boundary. An upper portion of a bonding fixture is placed atop the second side plate in order to hold the core in place during the bonding of the pieces together. Thereafter, the heat exchanger core 11 is bonded by a single metallurgical bonding operation such as brazing or the like. It is important to note that the tubes 24, header bars 32 and side plates 28 are all coated with braze alloy so that the stacked core can be clamped and subject the requisite bonding temperature. Manifolds, 16 and 18, are welded to the core at opposite ends of the tubes 24. Due to the folded ends of members 40 and 41, the thickness of the tube at the exposed ends is actually four times the thickness of the tube itself.

This feature ensures that the manifolds 16 and 18 can easily be attached by welding directly to the core face where the two members 40 and 41 have been joined.

A variety of modifications and improvements to the heat exchanger described herein are believed to be apparent to one skilled in the art. Accordingly, no limitation of the invention is intended except as set forth in the appended claims.

What I claim is:

1. A heat exchanger comprising:

a plurality of tubes defining a plurality of first flow paths, each tube including a first generally U-shaped member having a base portion and two legs generally perpendicular to the base portion, one leg further including two folds which define a trough therebetween;

a second member shaped identically to the first member, said second member rotated 180° with respect to the first member such that the leg of the first member slides within the trough of said second member and said leg of said second member slides within the trough of said first member, each of said tube having corrugated fins therein;

a plurality of pairs of generally C-shaped bars spacing said plurality of tubes apart from adjacent tubes, said bars being cross-wise to said tubes and each pair of bars defining a plurality of second flow paths;

an extended surface heat transfer element between each pair of bars;

an integral lanced tab at each end of said plurality of bars, each tab folded over itself toward the heat exchanger center and capturing a portion of said extended surface heat transfer element;

side plates on each side of said heat exchanger, said side plates spaced from one of said tubes by a pair of bars;

means for securing said first members, bars and said side plates together and for isolating said first and second flow paths from each other; and manifold means, sealingly attached to said tube ends, for disbursing a working fluid into said plurality of said first flow paths at one end of said tubes and for collecting said working fluid at the opposite ends of said tubes.

2. The heat exchanger of claim 1 wherein the means for securing comprises a metallurgical bond along said unfolded leg of one member and said folded leg of the other member, and between said bars, corrugated fins, extended surface heat transfer elements, tubes and side plates.

3. The heat exchanger of claim 1 wherein each of said tubes contain corrugated fins therein.

4. The heat exchanger of claim 1 wherein said tubes are generally flattened.

5. A heat exchanger comprising:

a plurality of tubes defining a plurality of first flow paths;

a plurality of pairs of generally C-shaped bars spacing said plurality of tubes apart from adjacent tubes, said bars extending generally perpendicular to said plurality of tubes and each pair of bars defining a plurality of second flow paths;

an extended surface heat transfer element between each pair of bars;

an integral lanced tab formed at each end of said bars, each tab folded over itself toward the heat exchanger center and capturing a portion of said extended surface heat transfer element between itself and said bar;

side plates on each side of said heat exchanger, said side plate spaced from one of said tubes by a pair of bars;

means for securing said tubes, bars, extended surface heat transfer elements and side plates together; and manifold means, sealingly attached to said tube ends for distributing a working fluid into said plurality of first flow paths at one end of said tubes and for selecting said working fluid at the opposite end of said tubes.

6. The heat exchanger of claim 5 wherein each of said tubes contain corrugated fins therein.

7. The heat exchanger of claim 5 wherein said tubes are generally flattened.

8. The heat exchanger of claim 5 wherein said means for securing comprises a metallurgical bond between said tubes, bars, extended surface heat transfer elements and side plates.

* * * * *

UNITED STATES PATENT AND TRADEMARK OFFICE

CERTIFICATE OF CORRECTION

PATENT NO. : 4,681,155

DATED : July 21, 1987

INVENTOR(S) : Theodore A. Kredo

It is certified that error appears in the above-identified patent and that said Letters Patent is hereby corrected as shown below:

IN THE SPECIFICATION

At Col. 2, line 40 delete one occurrence of the word "fluid".

IN THE CLAIMS

In Claim 1, line 29 add --,second members,-- after the word 'members'.

Signed and Sealed this

Fifteenth Day of December, 1987

*Attest:*

DONALD J. QUIGG

*Attesting Officer*

*Commissioner of Patents and Trademarks*